US005977726A

United States Patent [19]

Shishido

[11] Patent Number: 5,977,726

[45] Date of Patent: Nov. 2, 1999

[54] CRT SYSTEM USING ELECTROSTATIC QUADRUPLE LENS

[75] Inventor: Akira Shishido, Shiga, Japan

[73] Assignee: NEC Corporation, Tokyo, Japan

[21] Appl. No.: 08/839,944

[22] Filed: Apr. 24, 1997

[30] Foreign Application Priority Data

Apr. 25, 1996 [JP] Japan ..... 8-103042

[51] Int. Cl.[6] ..... H01J 29/58; H01J 29/48

[52] U.S. Cl. ..... 315/382; 313/414; 315/368.15; 315/368.21

[58] Field of Search ..... 315/368.15, 368.22, 315/368.23, 382; 313/414

[56] References Cited

U.S. PATENT DOCUMENTS

| | | | |
|---|---|---|---|
| 4,771,216 | 9/1988 | Blacker et al. | 315/382 |
| 4,945,284 | 7/1990 | Shimoma et al. | 313/414 |
| 5,663,617 | 9/1997 | Kobayashi | 315/382 |
| 5,831,399 | 11/1998 | Ohta et al. | 315/382.1 |

FOREIGN PATENT DOCUMENTS 1232643 9/1989 Japan .

*Primary Examiner*—Edward P. Westin
*Assistant Examiner*—Shane R Gardner
*Attorney, Agent, or Firm*—Sughrue, Mion, Zinn, Macpeak & Seas, PLLC

[57] ABSTRACT

A CRT system is provided, preventing the resolution on a phosphor screen from degrading due to the characteristic or performance variation and/or deviation of an electron gun. The electron gun has cathodes for emitting R, G, and B electron beams. First and second focusing electrodes focus the electron beams onto a phosphor screen. A drive unit has a power supply for supplying first and second focusing voltages to the first and second focusing electrodes, respectively. The second focusing voltage is an ac voltage with a parabolic waveform. The first focusing voltage is a dc voltage generated by dividing the second focusing voltage with the use of a resistor. A difference between the first and second focusing voltages generates an electrostatic quadruple lens in a space between the first and second focusing electrodes. The difference between the first and second focusing voltages is adjusted by changing the parabolic waveform of the second focusing voltage, thereby controlling the action of the electrostatic quadruple lens to compensate defocusing of the electrostatic quadruple lens.

8 Claims, 5 Drawing Sheets

CRT SYSTEM USING ELECTROSTATIC QUADRUPLE LENS

BACKGROUND OF THE INVENTION

1. Field of the Invention

The present invention, relates to a Cathode-Ray Tube (CRT) system and more particularly, to a color or monochrome CRT system including a CRT and a controller subsystem for controlling the CRT, in which an electron gun of the CRT is able to generate a dynamic, electrostatic quadrupole lens.

2. Description of the Prior Art

With conventional CRT systems, generally, the deflecting magnetic-field of the self-convergence type is spatially non-uniform. This non-uniform magnetic field has a horizontal distribution like a pin-cushion shape and a vertical distribution like a barrel shape, and generates a "magnetic quadrupole lens".

An electron beam that has been emitted from an electron gun and that passes through the deflecting magnetic-field is applied with a horizontal diverging action or force and a vertical converging action or force from the magnetic quadrupole lens, and as a result, the beam is deformed. The electron beam thus deformed generates a beam spot with some defocus on the phosphor screen of the CRT.

The defocus of the electron-beam spot becomes conspicuous in the periphery of the phosphor screen compared with the central area thereof, because the strength or intensity of the magnetic quadrupole lens varies dependent upon the deflection level of the electron beam (i.e., the relative position of the beam spot on the screen with respect to the center of the screen).

Accordingly, there arises a problem that the resolution of the CRT system degrades in the periphery of the phosphor screen.

To solve the problem of the resolution degradation, an electron gun with a "dynamic, electrostatic quadrupole lens" has been developed and practically used.

FIG. 1 schematically shows a part of a conventional color CRT system using this electron gun, which is disclosed in the Japanese Non-Examined Patent Publication No. 1-232643 published in September 1989. This system has an electron gun emitting three electron beams for red (R), green (G), and blue (B). However, only one of the electron beams is explained here for the sake of simplification of description.

As shown in FIG. 1, an electron gun 111 has a cathode 112, a controlling electrode 113, a first accelerating electrode 114, a first focusing electrode 115, a second focusing electrode 116, and a second accelerating electrode 118, which are fixed on a pair of supports (not shown) made of an electrically insulating material such as glass. The cathode 112, the controlling electrode 113, the first and second accelerating electrodes 114 and 118, and the first and second focusing electrodes 115 and 116 are aligned at specific intervals along the central axis of the electron gun 111.

The cathode 112 emits an electron beam (not shown). The controlling electrode 113 controls the amount of the electron beam emitted from the cathode 112. The first and second accelerating electrodes 114 and 118 accelerate the electron beam. The first and second focusing electrodes 115 and 116 focus the electron beam on a phosphor screen (not shown) of the conventional CRT system.

The conventional color CRT system of FIG. 1 further has a power supply 119 for supplying a first focusing voltage $E_1$ to the first focusing electrode 115 and a second focusing voltage $E_2$ to the second focusing electrode 116. The first focusing voltage $E_1$ is supplied to the first focusing electrode 115 through a resistor 120 with a resistance R. The second focusing voltage $E_2$ is supplied directly to the second focusing electrode 116.

As shown in FIG. 2, the first focusing voltage $E_1$ is a dc voltage, which is obtained by division of the second focusing voltage $E_2$ by the resistor 120. The second focusing voltage $E_2$ is an ac voltage with a parabolic waveform, which is generated by superposing an ac component with a parabolic waveform on a dc component in the power supply 119. The second focusing voltage $E_2$ is synchronized with the deflecting ac current. A voltage difference exists between the first and second focusing electrodes 115 and 116.

With the conventional color CRT system of FIG. 1, due to the application of the first and second focusing voltages $E_1$ and $E_2$, an electrostatic quadrupole lens (not shown) is generated in a space 117 between the opposing surfaces of the first and second focusing electrodes 115 and 116. The electron beam emitted from the cathode gun 112 is applied with a horizontal converging action or force and a vertical diverging action or force from the electrostatic quadrupole lens thus generated.

Consequently, the above beam-spot deformation action due to the magnetic quadrupole lens is compensated by the beam-spot deformation action due to the electrostatic quadrupole lens thus generated. As a result, the deformation or defocus of the beam-spot is substantially deleted within the whole phosphor screen.

Further, with the conventional color CRT system of FIG. 1, the first focusing voltage $E_1$ is obtained by dividing the second focusing voltage $E_2$ with the use of the resistor 120. Because of the action of the resistor 120, the parabolic ac component of the second focusing voltage $E_2$ is substantially removed, resulting in the first focusing voltage $E_1$ containing only the dc component. The value of the first focusing voltage $E_1$ will be equal to a time average of the second focusing voltage $E_2$.

This configuration of the single power supply as shown in FIG. 1 leads to an advantage that only one power supply is needed for supplying the first and second focusing voltages $E_1$ and $E_2$. However, on the other hand, this configuration means that the first focusing voltage $E_1$ is automatically determined by the second focusing voltage $E_2$. In other words, the difference between the first and second focusing voltages $E_1$ and $E_2$ cannot be adjusted by changing the amplitude of the second focusing voltage.

This automatic determination of the first focusing voltage $E_1$ will cause a problem that the focusing characteristic or performance of the CRT system is unable to be adjusted in response to the characteristic or performance variation and/or deviation of the actual electron gun 111. In other words, the operation of the electron gun 111 is not always optimized, resulting in resolution degradation.

SUMMARY OF THE INVENTION

Accordingly, an object of the present invention is to provide a CRT system that is able to prevent the resolution on a phosphor screen from degrading due to the characteristic or performance variation and/or deviation of an electron gun.

Another object of the present invention is to provide a CRT system capable of improvement in quality and fabrication yield.

The above objects together with others not specifically mentioned will become clear to those skilled in the art from the following description.

A CRT system according to the present invention includes a vacuum container, an electron gun for emitting an electron beam, a deflector for deflecting the electron beam, a phosphor screen onto which the deflected electron beam is focused, and a drive unit for driving the electron gun and the deflector to display an image on the phosphor screen.

The electron gun has a cathode for emitting the electron beam, and first and second focusing electrodes for focusing the electron beam onto the phosphor screen.

The drive unit has a power supply for supplying first and second focusing voltages to the first and second focusing electrodes of the electron gun, respectively. The second focusing voltage is an ac voltage with a parabolic waveform. The first focusing voltage is a dc voltage generated by dividing the second focusing voltage with the use of a resistor. A difference between the first and second focusing voltages generates an electrostatic quadrupole lens in a space between the first and second focusing electrodes.

The difference between the first and second focusing voltages is adjusted by changing the parabolic waveform of the second focusing voltage, thereby controlling the action of the electrostatic quadrupole lens to compensate defocusing of the electrostatic quadrupole lens during a specific period in a retrace time.

With the CRT system according to the present invention, since the dc first focusing voltage is generated by dividing the second focusing voltage with the use of a resistor, the first focusing voltage is equal to a time average of the second focusing voltage.

On the other hand, when the parabolic waveform of the second focusing voltage is changed, the time average of the second focusing voltage varies even if the amplitude of the second focusing voltage is not changed. This means that the first focusing voltage is able to be adjusted by changing the parabolic waveform of the second focusing voltage while keeping the amplitude of the second focusing voltage unchanged.

Therefore, the difference between the first and second focusing voltages is able to be adjusted in such a way that the action of the electrostatic quadrupole lens is optimized in response to the characteristic or performance variation and/or deviation of the electron gun.

In other words, the resolution degradation (i.e., the defocusing phenomenon of the focused and deflected electron beam) on the phosphor screen is prevented from occurring even if the electron gun has some characteristic or performance variation and/or deviation.

This prevention of the resolution degradation on the phosphor screen independent upon the actual characteristic or performance of the electron gun leads to improvement in quality and fabrication yield.

In a preferred embodiment of the CRT system according to the present invention, the parabolic waveform of the second focusing voltage is clamped at a specific clamping level for a clamping time in the retrace time.

In this case, the action of the electrostatic quadrupole lens is adjusted by changing at least one of the clamping level and the clamping time.

In another preferred embodiment of the CRT system according to the present invention, the parabolic waveform of the second focusing voltage is folded at a specific folding level for a folding time in the retrace time.

In this case, the action of the electrostatic quadrupole lens is adjusted by changing at least one of the folding level and the folding time. The change of the folded state is simply realized by shifting the clamping level.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
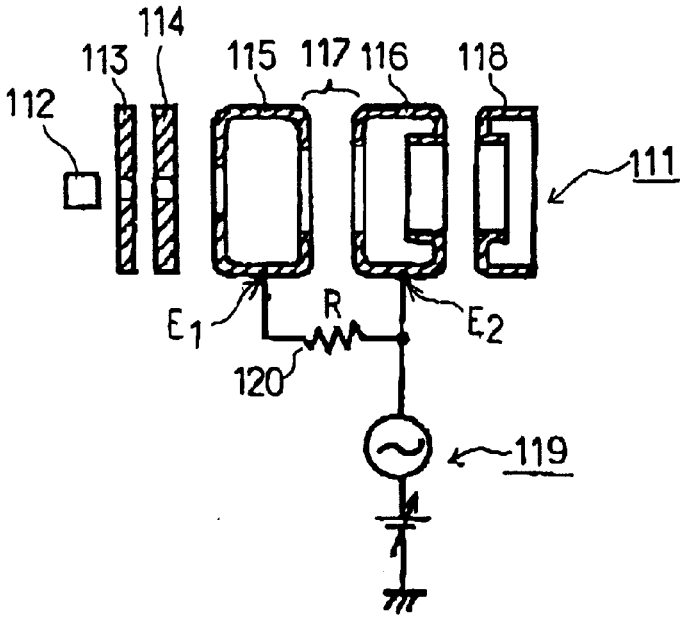
FIG. 1 PRIOR ART
FIG. 1 is a schematic view showing a main part of a conventional color CRT system.

Preferred embodiments of the present invention will be described below referring to the drawings attached.

FIRST EMBODIMENT

A color CRT system according to a first embodiment is shown in FIGS. 3, 4, 5, and 6.

Figure 3:
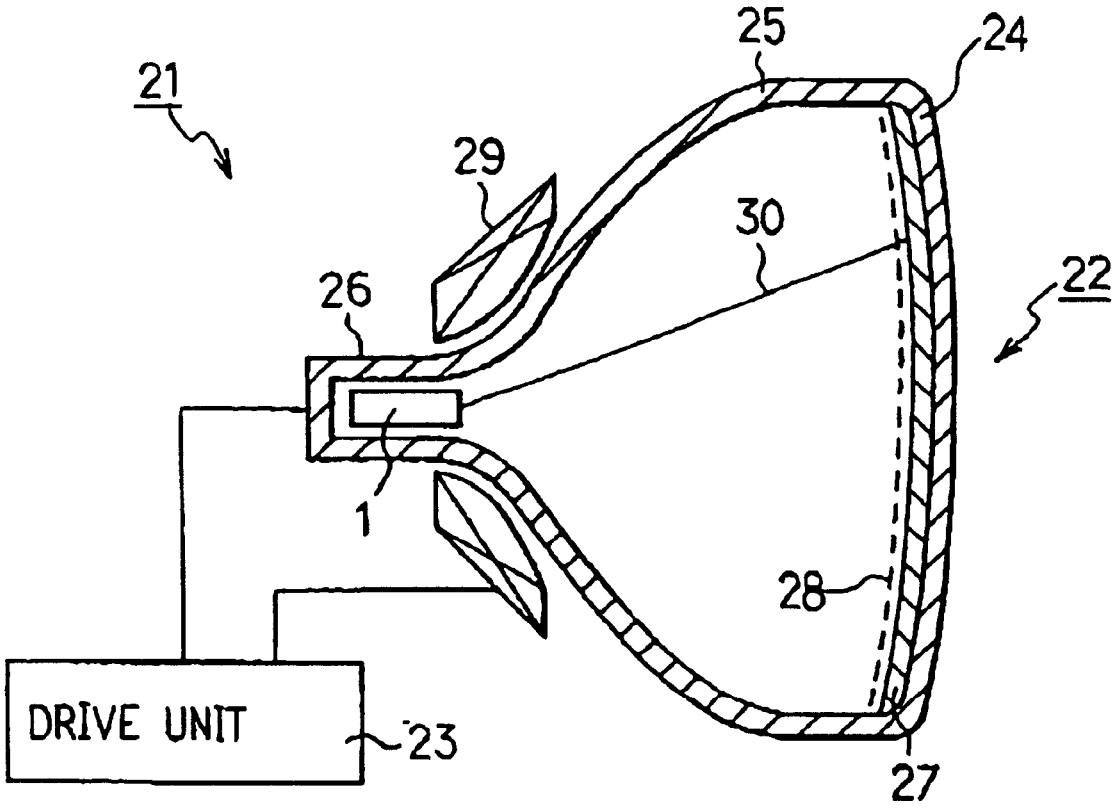
FIG. 3 is a schematic cross-sectional view showing a typical, basic structure of a color CRT system.

As shown in FIG. 3, the color CRT system 21 according to the first embodiment includes a color CRT 22 and a drive unit 23 for driving the CRT 22.

The CRT 22 has a face panel 24 on which an image is displayed. The panel 24 is connected to a roughly cone-shaped funnel 25 having a tubular neck 26, thereby forming a vacuum container. This container is made of glass.

A phosphor screen 27 is formed onto and extends along the inner surface of the face panel 24 in the container. A lot of stripes of phosphor materials for red (R), green (g) and blue (B) colors are horizontally and vertically arranged in the entire phosphor screen 27. Each of the stripes is usually of a vertically elongated shape, i.e., of a vertically extending strip.

A shadow mask 28 is fixed apart from the face panel 24 and opposed to the phosphor screen 27 in the container The mask 28 has a number of slots allowing selectively three electron beams 30 for R, G, and B colors to arrive at the phosphor screen 27 through the mask 28.

In the neck 26 of the funnel 25, an electron gun 1 for producing and emitting the three electron beams 30 has three cathodes horizontally arranged in line. In other words, the gun 1 has the in-line structure. A deflection yoke 29 is provided around the funnel 25, which deflects horizontally and vertically the electron beams 30, respectively.

The electron beams 30 for R, G and B colors, which are emitted from the corresponding cathodes in the electron gun 1, are deflected by the horizontal and vertical deflecting magnetic fields generated by the deflection yoke 29, and horizontally scanned over the entire phosphor screen 27. The beams 30 passing through the slots in the shadow mask 28 strike the corresponding stripes of the phosphor materials and excite them, thereby displaying a color image on the face panel 24.

Figure 4:
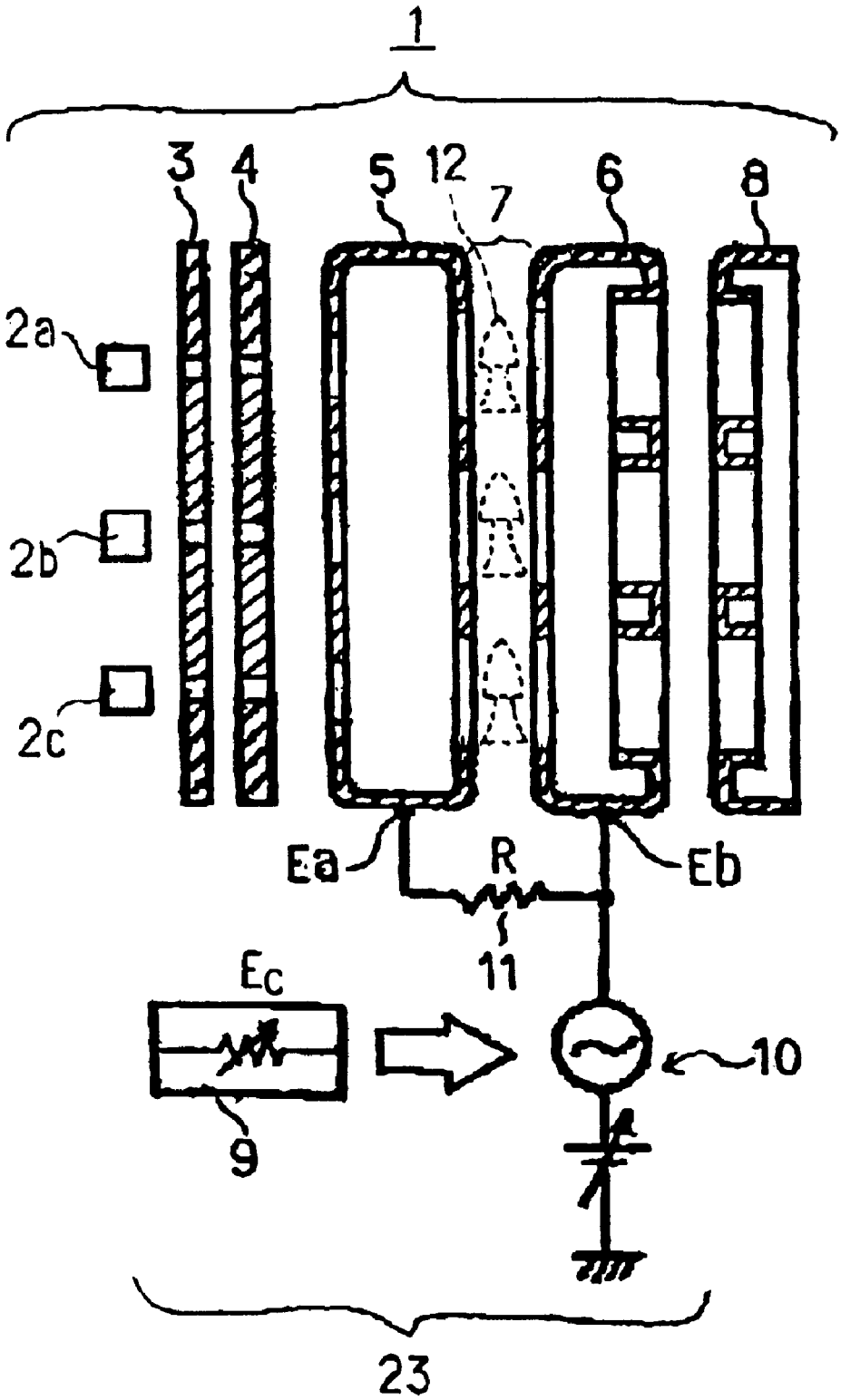
FIG. 4 is schematic view showing a main part of a CRT system according to a first embodiment of the present invention.

The main part of the color CRT system 21 according to the first embodiment is shown in FIG. 4.

In FIG. 4, the electron gun 1 has three cathodes 2*a*, 2*b*, and 2*c* for the R, G, and B colors, a controlling electrode 3, a first accelerating electrode 4, a first focusing electrode 5, a second focusing electrode 6, and a second accelerating electrode 8, which are fixed on a pair of supports (not shown) made of an electrically insulating material such as glass.

The cathodes 2*a*, 2*b*, and 2*c* are aligned at specific intervals along a straight line perpendicular to the central axis of the electron gun 1. The set of the cathodes 2*a*, 2*b*, and 2*c*, the controlling electrode 3, the first and second accelerating electrodes 4 and 8, and the first and second focusing electrodes 5 and 6 are aligned at specific intervals along the central axis of the electron gun 1.

The cathodes 2*a*, 2*b*, and 2*c* generate and emit three electron beams 30 for R, G, and B colors, respectively. The electron beams 30, which pass through the corresponding penetrating holes formed in the electrodes 3, 4, 5, 6, and 8, respectively, are affected by the electrodes 3, 4, 5, 6, and The controlling electrode 3 controls the amount of the electron beams 30 emitted from the cathodes 2*a*, 2*b*, and 2*c*. The first and second accelerating electrodes 4 and 8 accelerate the electron beams 30. The first and second focusing electrodes 5 and 6 focus the electron beams 30 on the phosphor screen 27 of the CRT 22.

As shown in FIG. 4, the drive unit 23 of the CRT system 21 according to the first embodiment has a power supply 10 for supplying a first focusing voltage $E_a$ to the first focusing electrode 5 and a second focusing voltage $E_b$ to the second focusing electrode 6. The first focusing voltage $E_a$ is supplied to the first focusing electrode 5 through a resistor 11 with a resistance R. The second focusing voltage $E_b$ is supplied directly to the second focusing electrode 6. This configuration is the same as that of the conventional CRT system of FIG. 1.

Unlike the conventional CRT system of FIG. 1, in the CRT system 21 according to the first embodiment, the first focusing voltage $E_a$ is controlled with the use of a control voltage $E_c$ generated in a control circuit 9. The control circuit 9 is provided in the drive unit 23 together with the power supply 10. The control voltage $E_c$ is used for clamping the second focusing voltage $E_b$, thereby decreasing the first focusing voltage $E_a$. The control voltage $E_c$ is superposed on the second focusing voltage $E_b$ as necessary.

Here, the control voltage $E_c$ has a saw-toothed waveform, which is readily generated by a deflecting voltage or current for the electron beams 30. The reason is that a voltage with a saw-toothed waveform is usually generated by a flyback transformer (not shown) provided in the drive unit 23, and actually used.

Figure 5:
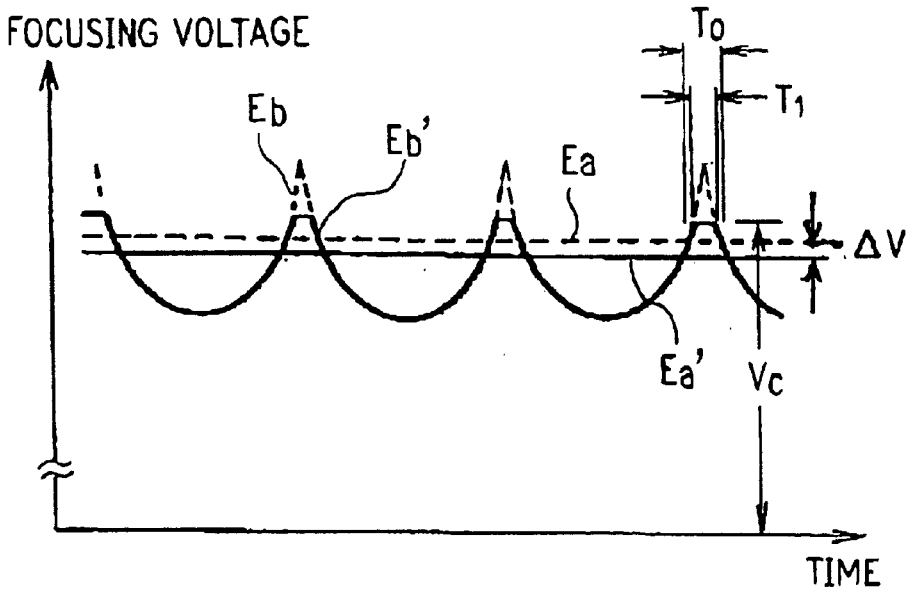
FIG. 5 is a time chart showing the waveform of the first and second focusing voltages in the CRT system according to the first embodiment of FIG. 4, in which the parabolic waveform of the second focusing voltage is clamped at a specific voltage level.

FIG. 5 is a time chart showing the waveform of the first and second focusing voltages $E_a$ and $E_b$ in the CRT system according to the first embodiment.

Figure 2:
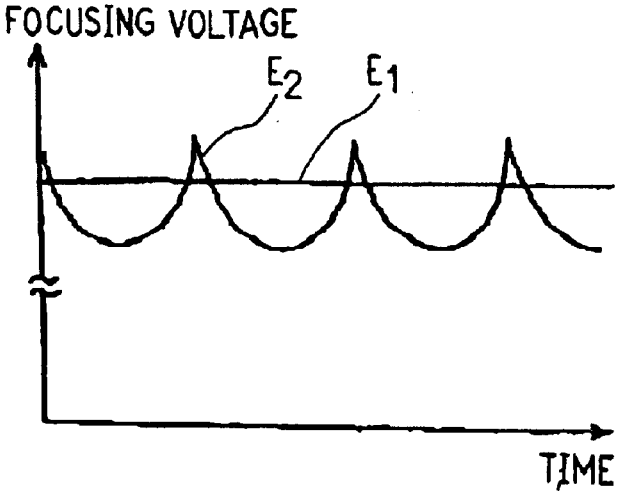
FIG. 2 PRIOR ART
FIG. 2 is a time chart showing the waveform of the first and second focusing voltages in the conventional CRT system of FIG. 1.

As shown in FIG. 5, during the time except for a fixed clamping period $T_1$ in each specific retrace time $T_0$ of the CRT system 21, where $T_1 \leqq T_0$, the first and second focusing voltages $E_a$ and $E_b$ are the same as the first and second focusing voltages $E_1$ and $E_2$ in the conventional CRT system of FIGS. 1 and 2.

Specifically, the first focusing voltage $E_a$ is a dc voltage, which is obtained by division of the second focusing voltage $E_b$ by the resistor 11. The second focusing voltage $E_b$ is an ac voltage with a parabolic waveform, which is generated by superposing an ac component with a parabolic waveform on a dc component in the power supply 10. The second focusing voltage $E_b$ varies to be synchronized with the specific deflecting ac voltage or current. A voltage difference is generated between the first and second focusing electrodes 5 and 6 in order to form three electrostatic quadrupole lenses 12 for the electron beams 30 for the R, G, and B colors in the space between the opposing surfaces of the first and second focusing electrodes 5 and 6, as shown in FIG. 4.

However, unlike the conventional CRT system of FIGS. 1 and 2, during the fixed clamping period $T_1$ in each specific retrace time $T_0$, the parabolic waveform of the second focusing voltage $E_b$ is clamped at a specific voltage level by the applied control voltage $E_c$. As a result, the waveform of $E_b$ has no peak during the clamping period $T_1$.

Since the first focusing voltage $E_a$ is equal to the time average of the second focusing voltage $E_b$, the first focusing voltage $E_a$ decreases to the level as shown by $E_a'$ by a voltage difference $\Delta V$ due to the selective clamping of the parabolic waveform of $E_b$.

Figure 6:
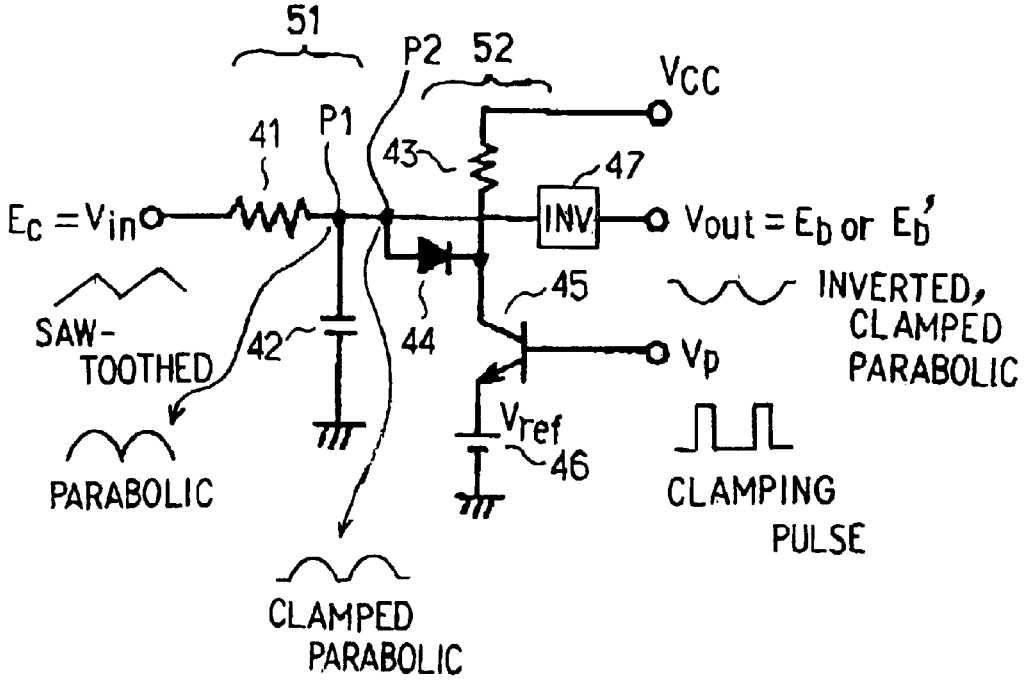
FIG. 6 is a circuit diagram of an integrator circuit and a clamping circuit, which are used for the CRT system according to the first embodiment of FIG. 4.

The clamping of the parabolic waveform of $E_b$ can be readily realized by adding a clamping circuit 52 to an integrator circuit 51, as shown in FIG. 6.

In FIG. 6, a resistor 41 and a capacitor 42 constitute the integrator circuit 51. One end of the resistor 41 is applied with an input voltage $V_{1n}$ with a saw-toothed waveform, which is equal to the control voltage $E_c$. The other end of the resistor 41 and one end of the capacitor 42 is connected in common to a connection point P1. The other end of the capacitor 42 is connected to the ground.

A resistor 43, a diode 44, an npn-type bipolar transistor 45, and a reference voltage source 46 supplying a dc reference voltage $V_{ref}$ constitute the clamping circuit 52. One end of the resistor 43 is connected to a power supply supplying a dc supply voltage $V_{cc}$ of the CRT system 21. The other end of the resistor 43 is connected to a collector of the transistor 45. An emitter of the transistor 45 is connected to a positive electrode of the voltage source 46. A negative electrode of the voltage source 46 is connected to the ground. A base of the transistor 45 is applied with a pulsed clamping voltage $V_p$ with a square waveform. An anode of the diode 44 is connected to a connection point P2 that is directly connected to the connection point P1.

An input terminal of an inverter 47 is connected to the connection point P2. An output voltage $V_{out}$, which is equal to the second focusing voltage $E_b$ or $E_b'$, is derived from an output terminal of the inverter 47.

As seen from FIG. 6, the control voltage $E_c$ is first applied to the integrator circuit 51 as the input voltage $V_{in}$. An output voltage of the integrator circuit 51 generated at the connection point P1 has a parabolic waveform due to an integration operation.

The voltage with the parabolic waveform is then applied to the clamping circuit 52. An output voltage of the clamping circuit 52 at the connection point P2 has a clamped parabolic waveform due to a clamping operation.

The output voltage of the clamping voltage 52 thus obtained is further inverted by an inverter 47 whose input terminal is connected to the connection point P2. As a result, the second focusing voltage $E_b$ or $E_b'$ is derived at an output terminal of the inverter 47 as the output voltage $V_{out}$.

The pulsed clamping voltage $V_p$, which is synchronized with the deflecting or retracing voltage, is applied to the base of the transistor 45. Thus, the second focusing voltage $E_b$ is selectively clamped for the clamping period $T_1$, resulting in the output voltage with the clamped parabolic waveform in the clamping circuit 52.

With the color CRT system 21 according to the first embodiment of FIGS. 3, 4, 5, and 6, due to the application of the first and second focusing voltages $E_a$ and $E_b$ to the first and second focusing electrodes 5 and 6, three electrostatic quadrupole lenses 12 for the R, G, and B colors are generated in the space 7 between the opposing surfaces of the first and second focusing electrodes 5 and 6. The three electron beams 30 for the R, G, and B colors, which have been emitted from the corresponding cathodes 2*a*, 2*b*, and 2*c*, are applied with a horizontal converging action or force and a vertical diverging action or force from the electrostatic quadrupole lenses 12 thus generated.

Consequently, the above beam-spot deformation action by the magnetic quadrupole lens is compensated by the beam-spot deformation action by the electrostatic quadrupole lenses 12 thus generated. As a result, the deformation or defocus of the beam-spot is substantially deleted within the whole phosphor screen 27.

Further, since the parabolic waveform of the second focusing voltage $E_b$ is repeatedly changed during the clamping periods $T_1$, the time average of the second focusing voltage $E_b$ decreases to the level $E_b'$ during the period $T_1$ even if the amplitude of the second focusing voltage $E_b$ is not changed. This means that the first focusing voltage $E_a$ is able to be decreased to the voltage level $E_a'$ by changing the parabolic waveform of the second focusing voltage $E_b$ while keeping the amplitude of the second focusing voltage $E_b$ unchanged.

Therefore, the difference $\Delta V$ between the two voltage levels of the first voltage $E_a$ is able to be adjusted in such a way that the action of the electrostatic quadrupole lenses 12 is optimized in response to the characteristic or performance variation and/or deviation of the actual electron gun 1.

In other words, the resolution degradation (i.e., the defocusing phenomenon of the focused and deflected electron beams 30) on the phosphor screen 27 is prevented from occurring even if the electron gun 1 has some characteristic or performance variation and/or deviation.

This prevention of the resolution degradation on the phosphor screen 27 independent upon the actual characteristic or performance of the electron gun 1 leads to improvement in quality and fabrication yield of the CRT system 21.

In the first embodiment, there arises an advantage that the clamping voltage level and the clamping period are readily adjusted by changing the reference voltage $V_{ref}$ in the clamping circuit 52.

Except for the clamping period $T_1$, the first and second focusing voltages $E_a$ and $E_b$ are set to minimize the deflection defocusing and therefore, the optimum-focused electron beams 30 are generated within the whole phosphor screen 27. As a result, no problem takes place in the display quality.

SECOND EMBODIMENT

Figure 7:
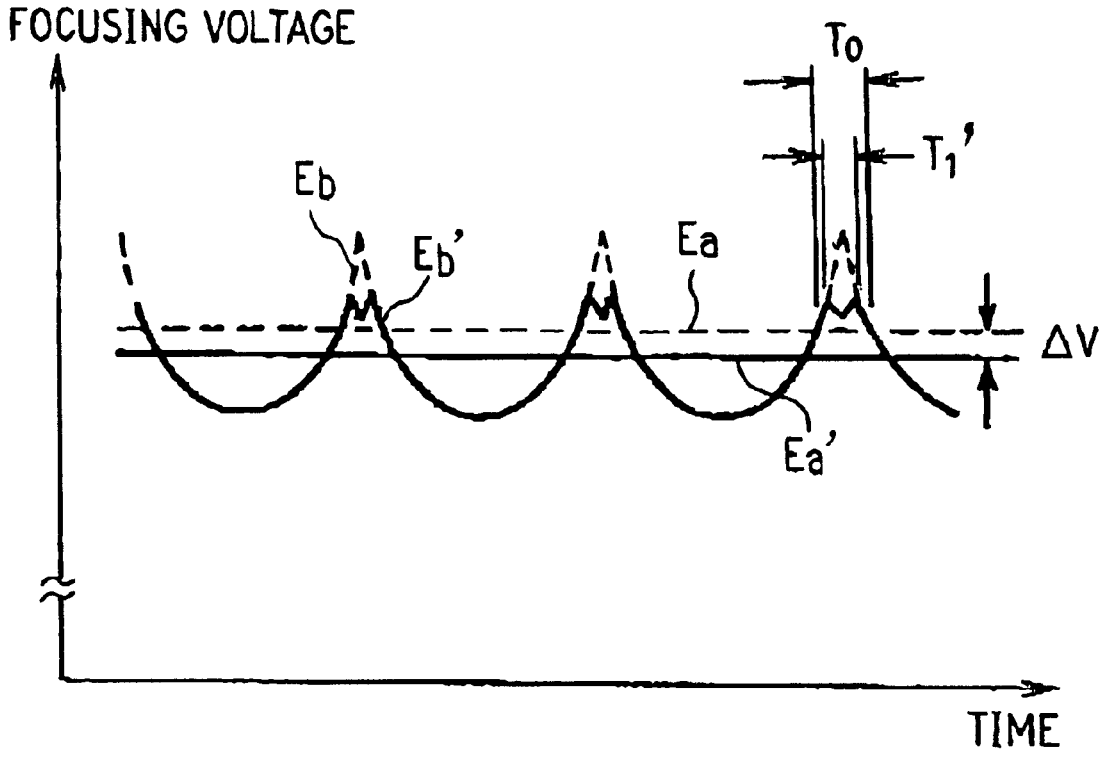
FIG. 7 is a time chart showing the waveform of the first and second focusing voltages in a CRT system according to a second embodiment, in which the parabolic waveform of the second focusing voltage is folded at a specific voltage level.

A color CRT system according to a second embodiment is the same in configuration as that of the first embodiment except that the second focusing voltage $E_b$ is folded during the specific folding period $T_1'$, as shown in FIG. 7.

Therefore, the description relating to the same configuration is omitted here by adding the same reference numerals as those in the color CRT system 21 according to the first embodiment for the sake of simplification of description.

In the CRT system according to the second embodiment, since the second focusing voltage $E_b$ is folded, there is an additional advantage that the obtainable voltage difference $\Delta V$ between the voltage levels $E_a$ and $E_a'$ is larger than the case of the system according to the first embodiment.

Except for the folding period $T_1'$, the first and second focusing voltages $E_a$ and $E_b$ are set to minimize the deflection defocusing and therefore, the optimum-focused electron beams 30 are generated within the whole phosphor screen 27. As a result, no problem takes place in the display quality.

In the above first and second embodiments, a color CRT system is explained. However, it is needless to say that the present invention may be applied to a monochrome CRT system.

Also, an electron gun of the in-line type is used for a color CRT in the above embodiments. However, an electron gun of any other type such as the delta-type may be used.

Further, although an electron gun has two focusing electrodes and two accelerating electrodes in the above embodiments, any electron gun having three or more focusing electrodes and/or three or more accelerating electrodes may be used in the present invention.

The resistor 11 is located outside the glass container in the first and second embodiments. However, the resistor 11 may be located inside the container.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. A CRT system comprising:

(a) a vacuum container;

(b) an electron gun for emitting an electron beam;

said electron gun being located in said container;

said electron gun having a cathode for emitting said electron beam and first and second focusing electrodes for focusing said electron beam;

(c) a deflector for deflecting said electron beam;

said deflector being located outside said container;

(d) a phosphor screen onto which said deflected electron beam is focused;

said phosphor screen being located in said container;

(e) a drive unit for driving said electron gun and said deflector to display an image on said phosphor screen;

said drive unit having a power supply for supplying first and second focusing voltages to said first and second focusing electrodes of said electron gun, respectively;

(f) said second focusing voltage being an ac voltage with a parabolic waveform;

(g) said first focusing voltage being a dc voltage generated by dividing said second focusing voltage using a resistor; and (h) a difference between said first and second focusing voltages generating an electrostatic quadrupole lens in a space between said first and second focusing electrodes;

(i) said difference between said first and second focusing voltages being adjusted by changing said parabolic waveform of said second focusing voltage, thereby controlling the action of said electrostatic quadrupole lens to compensate defocusing of said electrostatic quadrupole lens during a specific period in a retracting time, wherein said parabolic waveform of said second focusing voltage is folded at a specific folding voltage level for a folding period in said retrace time.

2. The CRT system as claimed in claim 1, wherein said action of said electrostatic quadrupole lens is controlled by changing at least one of the folding voltage level and the folding period.

3. The CRT system as claimed in claim wherein said folding of said parabolic waveform of said second focusing voltage is performed in synchronization with a retrace pulse.

4. A CRT system comprising:

first and second focusing electrodes for focusing an electron beam; and a power supply for supplying first and second focusing voltages to said first and second focusing electrodes, respectively;

said second focusing voltage having a parabolic waveforn which is folded at a specific folding voltage level for a folding period in a retrace time.

5. The CRT system set forth in claim 4, wherein said first focusing voltage is a dc voltage generated by dividing said second focusing voltage using a resistor.

6. The CRT system of claim 5, wherein said folding of said parabolic waveform of said second focusing voltage is performed in synchronization with a retrace pulse.

7. The CRT system of claim 6, wherein said action of said electrostatic guadrupole lens is adjusted by changing at least one of the folding level and the folding period.

8. The CRT system of claim 5, wherein said folding of said parabolic waveform of said second focusing voltage is performed in synchronization with a retrace pulse.

* * * * *